US006155008A

United States Patent [19]

McKee

[11] Patent Number: 6,155,008

[45] Date of Patent: Dec. 5, 2000

[54] PASSIVE VENTING DEVICE

[75] Inventor: James McKee, Barrie, Canada

[73] Assignee: Canplas Industries Ltd., Barrie, Canada

[21] Appl. No.: 09/282,126

[22] Filed: Mar. 31, 1999

[51] Int. Cl.[7] ..... E04B 7/00; E04H 12/28

[52] U.S. Cl. ..... 52/198; 52/200; 52/199

[58] Field of Search ..... 52/200, 198, 199

[56] References Cited

U.S. PATENT DOCUMENTS

| | | | |
|---|---|---|---|
| D. 376,007 | 11/1996 | Thomas . | |
| 1,547,916 | 7/1925 | Hoffman . | |
| 3,085,490 | 4/1963 | Field . | |
| 3,934,383 | 1/1976 | Perry et al. . | |
| 4,196,657 | 4/1980 | Crongeyer et al. . | |
| 4,307,549 | 12/1981 | Clanton . | |
| 4,357,381 | 11/1982 | Wilson | 428/174 |
| 4,468,899 | 9/1984 | Miller . | |
| 4,621,569 | 11/1986 | Fioratti . | |
| 4,683,687 | 8/1987 | Crider . | |
| 4,730,552 | 3/1988 | Murray . | |
| 5,062,247 | 11/1991 | Dittmer | 52/200 |
| 5,212,913 | 5/1993 | Whitehead . | |
| 5,341,610 | 8/1994 | Moss . | |
| 5,435,780 | 7/1995 | Ayles . | |
| 5,561,952 | 10/1996 | Damron | 52/198 |
| 5,675,940 | 10/1997 | Behar et al. | 52/58 |

*Primary Examiner*—Carl D. Freidman
*Assistant Examiner*—Patrick J. Chavez
*Attorney, Agent, or Firm*—Hoffman & Baron, LLP

[57] ABSTRACT

A passive venting device is disclosed for venting a building enclosure comprising a base member having an outer flange for securing said base member to a surface, a vent structure within said base member for permitting gases and vapors to pass through said base member, the vent structure including a filter screen to prevent objects from passing through the base member and a cap member immovably mounted to the base member and spaced therefrom sufficiently to permit the free flow of air between the cap member and the base member and through the vent structure. At least said cap member is integrally composed of a translucent material. This allows external ambient light to travel through the cap member to illuminate the building enclosure.

21 Claims, 2 Drawing Sheets

PASSIVE VENTING DEVICE

FIELD OF THE INVENTION

This invention relates generally to the field of venting devices, and in particular, to passive venting devices.

BACKGROUND OF THE INVENTION

Virtually all buildings and enclosures where human activity takes place require venting of one type of another. The type of venting device employed will depend on the kind of enclosure to be vented. For example, bathrooms containing showers typically have active vents with fans to vent steam to the outdoors. Kitchens, particularly in restaurants and hotels, similarly have powered vents for removing smoke and steam to the outdoors.

Other types of enclosures, such as attics and yard sheds, do not require active venting. However, such enclosures do typically require a passive vent to allow for air flow from the enclosure to the atmosphere. Such venting is required, for example, to prevent a buildup of moisture in the enclosure. Passive vents do not include a mechanism for forcing air out of the enclosure. Rather, they simply include a vent structure in the form of an air conduit which allows air flow. Passive vents are well-known and have been extensively used in the past. Although typically formed of metal, good results have been achieved more recently with plastic vents.

In addition to the venting of air from attic spaces and sheds, there are other needs for building enclosures, such as the need for light. In some cases, wiring is provided for electric lights, but spaces such as attics and sheds are typically left unwired, thus creating a need for the use of flashlights and the like.

There have been attempts in the past to provide both functions through a single structure. For example, U.S. Pat. No. 5,561,952 teaches a static roof vent comprising a base/flange containing an air conduit, and a hood. The hood includes a translucent oriel located above the air conduit. However, this device is difficult and expensive to manufacture, in that the central oriel is made from an expensive clear material which must be inserted into specially designed opaque mounts which in turn are attached to the roof.

U.S. Pat. No. 5,435,780 discloses a ventilated skylight having a light transmissive dome. The dome is supported by a support ring which is initially provided in two halves and must be welded together for use. The support ring is then installed on a soaker tray which is in turn is attached to the roof. Separate ventilation tabs are inserted into the underside of the light transmissible dome to provide ventilation. However, this device is complicated and expensive to assemble, as it requires many different parts for operation, some of which must be welded. It is also expensive to manufacture because of the large number of parts.

U.S. Pat. No. 3,934,383 discloses a roof vent for use in vans and the like. The roof vent cap is formed of a light-transmissive plastic resin. The cap is opened by turning a crank, and the cap opens at an angle. When the cap is closed, there is no venting. However, this device is expensive and complex to manufacture, requiring a complex cranking and opening assembly. Furthermore, light transmissive plastic resins typically degrade from exposure to ultraviolet light in the outdoors, taking on an unattractive yellow appearance. This patent does not address this yellowing problem.

U.S. Pat. No. 4,730,552 discloses a ventilating skylight. The device includes a housing having an opaque top wall.

The housing includes front and rear openings through which sunlight may pass when the door to those openings are open. There is further a transparent dividing wall below the openings and parallel to the top wall. The transparent dividing wall has an air flow passage at its centre. However, this device is difficult and expensive to manufacture, assemble and install. It is fabricated from a number of different materials and consists of a large number of pieces, some of which are attached to one another by hinges, thus increasing the complexity of manufacture and assembly.

SUMMARY OF THE INVENTION

Therefore, what would be desirable is a passive venting device which provides adequate illumination to the enclosure being vented, is simple and inexpensive to manufacture and install, and is equipped to have an attractive appearance upon installation and in the long term.

Accordingly, the present invention is directed to a passive venting device for venting a building enclosure comprising a base member having an outer flange for securing the base member to a surface. Contained within the base member is a vent structure for permitting gases and vapours to pass through the base member, the vent structure including a filter screen to prevent objects from passing through the base member. The passive venting device further comprises a cap member immovably mounted to the base member and spaced therefrom sufficiently to permit the free flow of air between the cap member and the base member through the vent structure. The cap member is integrally moulded from a translucent material. With respect to this invention, "translucent" means light transmissive but not transparent. Ambient light travels through the cap member, filter screen and vent structure and into the building enclosure being vented.

In another aspect of the invention, the cap member is composed of a translucent material having a sufficient light transmission efficiency such that, at typical daytime ambient light levels, sufficient light is transmitted into the enclosure to permit the performance of various seeing tasks. In particular, at least enough light is transmitted to permit simple orientation of a person making a short temporary visit. More particularly, enough light is transmitted to permit occasional performance of a visual task and most preferably, enough light is transmitted for the performance of visual tasks of high contrast or large size.

In still another aspect of the present invention, the cap member is composed of a translucent plastic resin wherein the translucent plastic resin includes an additive for inhibiting discoloration where enough additive is added to inhibit discoloration but not enough to adversely compromise the light transmissive properties of the roof vent. The preferred range of light transmissive efficiency is greater than 40% with the most preferred range being between about 50% and 60%.

BRIEF DESCRIPTION OF THE DRAWINGS

Reference will now be made by way of example only, to drawings of the invention, which illustrate the preferred embodiment of the invention, and in which.

DETAILED DESCRIPTION OF THE PREFERRED EMBODIMENTS

Figure 1:
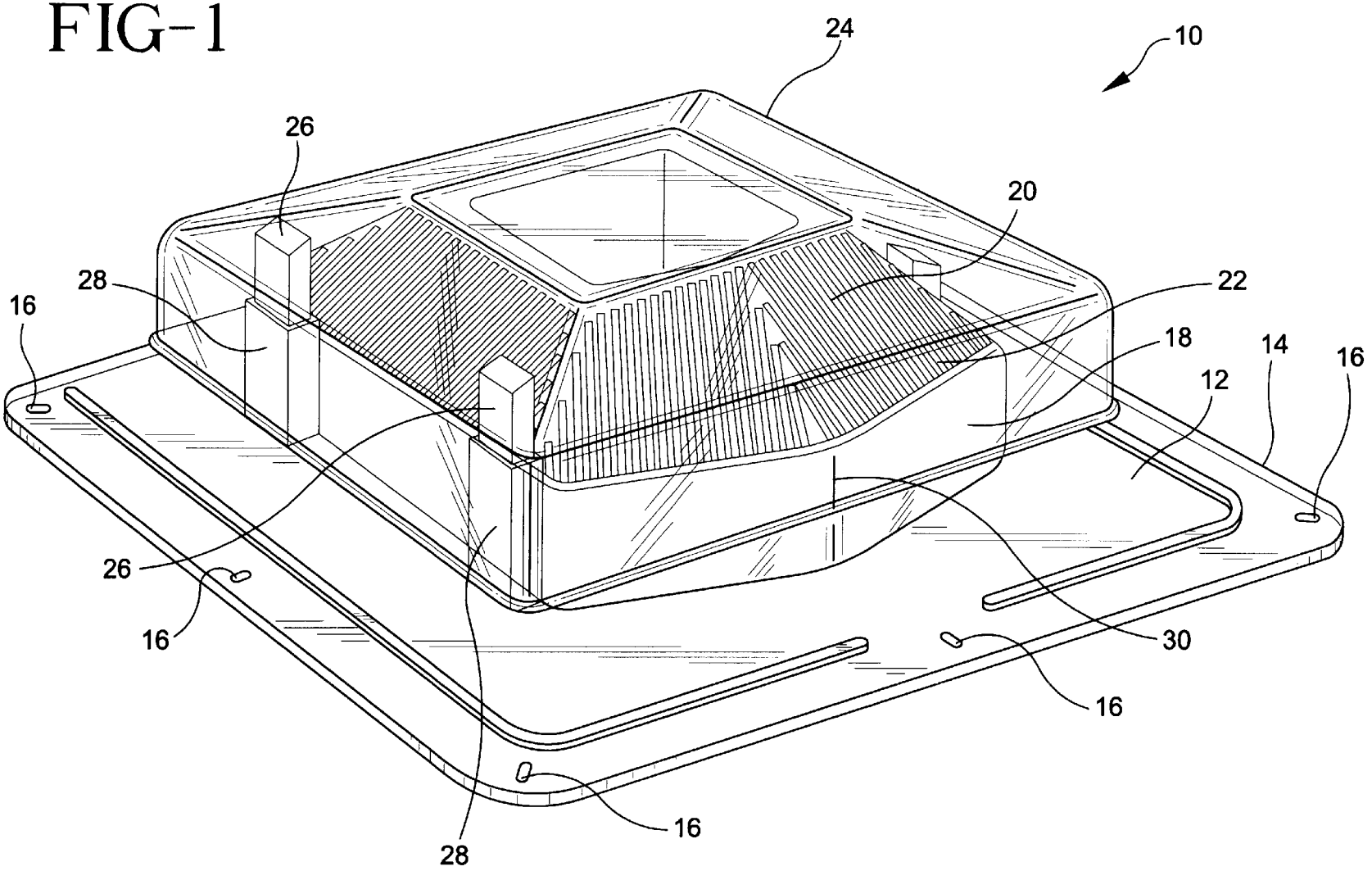
FIG. 1 is a perspective view of the passive venting device according to the present invention.

FIG. 1 illustrates the passive venting device 10 according to the present invention. The passive venting device 10 is for venting a building enclosure, and comprises a base member 12 having an outer flange 14 for securing the base member 12 to a surface. The flange 14 may be secured to the surface in any convenient manner, including clip, nails or screws. Preferably, the flange 14 includes a plurality of securing holes 16 through the outer flange 14. The securing holes 16 are adapted to accept nails or screws which can be used to secure the base member 12 to a surface, which would typically be a roof. The flange 14 may be of any convenient shape, and the securing holes 16 may be distributed on said flange 14 in any way which will allow the device to be securely fastened to said surface. Preferably, there are at least 7 securing holes 16 on the outer flange 14 spaced about at least three sides of the generally rectangular outer flange 14. Such a spacing arrangement allows the base member 12 to be adequately secured to the surface. The wide flange permits shingles to be lapped over the device, so the device is readily attached to a shingled roof.

The base member 12 further includes a vent structure 18 for permitting the gases and vapours to pass through the base member 12. The vent structure includes an aperture 17 (FIG. 2) through the base member 12 through which gases and vapours may pass. The vent structure 18 further includes a filter screen 20 to prevent objects from passing through the base member 12. Preferably, the filter screen 20 consists of a plurality of screen members 22 disposed across aperture 17, and spaced apart sufficiently to allow gases and vapours, as well as light, to pass through the filter screen 20.

The passive venting device further comprises a cap member 24 immovably mounted to the base member 12, and spaced from the base member 12 sufficiently to permit the free flow of air between the cap member 24 and the base member 12 through the vent structure 18.

The cap member 24 may be mounted on the base member 12 in any secure fashion. Examples include screws, nails, clips or glue. The cap is immovably mounted, meaning that the cap has a single position for operation of the invention, namely, spaced from the base to permit the free flow of air. In ordinary operation the cap cannot be opened and closed to alternately block and unblock the flow of air. In the preferred embodiment, the cap member 24 is mounted using four cap mounting shafts 26 and four corresponding cap mounting slots 28 which are open at each end. The cap mounting shafts 26 are positioned adjacent to each of the four corners of the cap member 24, which is generally rectangular when viewed from above or below. The cap mounting slots 28 are positioned so as to correspond with the cap mounting shafts 26, and are distributed on the vent structure 18 diagonally and radially inwardly from each of the four corners of the outer flange 14. The cap mounting shafts 26 are affixed to the cap member 24 extending downward, while the cap mounting slots 28 are formed on the outside of the vent structure 18, and are shaped to receive the cap mounting shafts 26.

Figure 2:
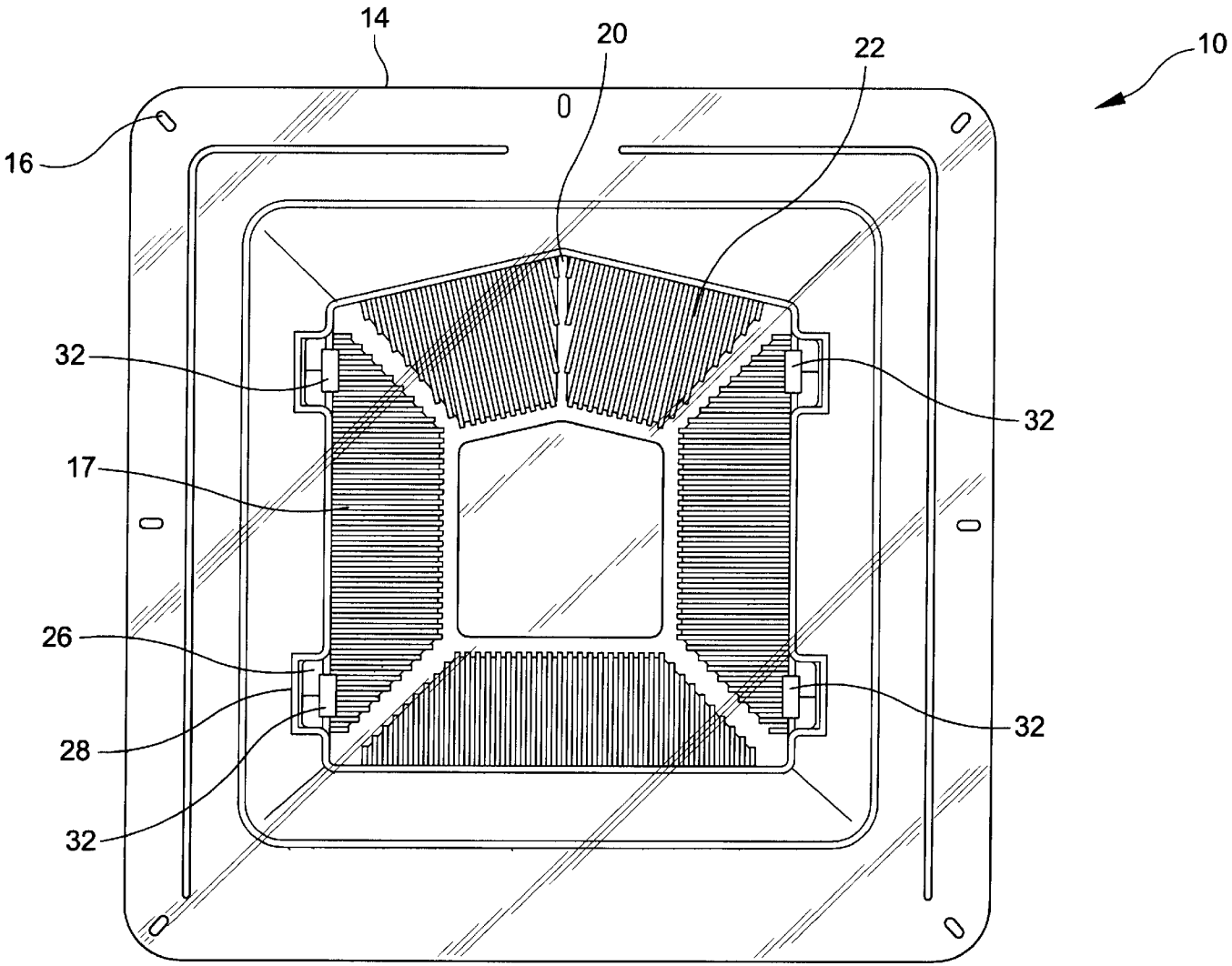
FIG. 2 is a bottom plan view of the passive venting device of FIG. 1.

At the end of each cap mounting shaft 26 is a lip 32 (FIG. 2).

When the cap mounting shaft 26 is inserted into the cap mounting slot 28, the lip compresses slightly. The lip 32 is then pushed through the cap mounting slot 28 and expands when it exits the opposite end of the slot, thus immovably mounting the cap member 24 by anchoring it onto the cap mounting slot. Cap member 24 is visible through base member 12.

The vent structure 18 when viewed from above is preferably generally rectangular, with three of its sides parallel to the sides of the outer flange 14. However, the fourth side of the vent structure 18 is slightly bent or angled, forming a peak 30 in the middle of the fourth side. When the passive venting device 10 is mounted on a sloped roof, the passive venting device 10 is positioned such that the peak 30 is pointed up the slope. This positioning prevents water from pooling against the side of the vent structure 18.

In accordance with the present invention, the cap member 24 is integrally composed of a translucent material which is preferably a mouldable plastic. Use of a plastic allows for cost effective and simple manufacturing using a moulding process.

In being integrally composed of a translucent material, the cap member may be of one piece or more, but the one piece construction is preferable because of the benefit of simpler construction and use. It will now be appreciated that because the cap member's material is moulded (preferably in one step) into a generally uniform translucent material, there is no need for a central clear plastic piece mounted and separately sealed against weather to an opaque plastic base piece as taught in the prior art. Rather, the preferred one piece cap member of the present invention is composed of a sufficiently translucent material such that light transmission is provided to the enclosure.

The base member 18 need not be translucent for operation of the present invention. Rather, the present invention may be employed with the screen members 22 spaced apart sufficiently to allow light to pass through the filter screen 20 and base member 12 into the building enclosure being vented. However, if the screen members are more widely spaced there is a risk that unwanted objects will penetrate the vent, such as pests and the like. Thus, most preferably, the base member 12 is integrally composed of the same translucent plastic resin as the cap member 24. This allows for cheaper and easier manufacture, as there is only one raw material which is purchased in bulk and fed into, for example, an injection moulding machine. Also, manufacturing the base member 12 from the same plastic resin allows for greater light transmission into the enclosure while hiding from view the unattractive rough cut edges of the hole that is made in the roof beneath the passive venting device to provide access to the building enclosure.

To provide adequate illumination within the enclosure being vented, the moulded plastic must have a sufficient light transmission efficiency such that, at typical daytime ambient light levels, sufficient light is transmitted into the enclosure being vented. "Light transmission efficiency" in respect of the present invention means the percentage of incident light hitting the device which is transmitted through the device. Typical enclosures for which the passive venting device would be used are, for example, attics and sheds. It is preferable to provide within such an enclosure sufficient illumination for simple orientation by a person making a short temporary visit. This is because such enclosures are usually used for storage of tools, equipment and other articles which must periodically be located. It would be more preferable to provide sufficient illumination for the occasional performance of a visual task inside such an enclosure. Most preferably, sufficient illumination is provided for the performance of visual tasks of high contrast or large size. Of course, it will be understood by those skilled in the art that the present invention relates to a passive venting and lighting device, which relies on the amount of light outside being sufficient to be transmitted through the device to perform the tasks as set out above. Clearly, the greater the outer light levels, the more light will be transmitted to the interior. Thus, in considering the above criteria it is to be kept in mind that the starting conditions are assumed to be the ambient light on a reasonably bright day.

Daylight levels may vary widely according to a number of variables, including latitude, time of day, time of year and weather conditions. The amount of such daylight entering the enclosure and its distribution therein depend on other factors as well, such as the angle of the venting device and the direction of any incident daylight. In a publication entitled "Daylight Availability Data for Selected Cities in the United States" complied for the U.S. Department of Energy in September 1982 by Claude Robbins et al. of the Solar Energy Research Institute of Golden, Colo., values of daylight are given for various cities in the U.S. at different times of day, times of year and weather conditions. For the purposes of illustration, certain typical values of daylight illuminance are provided. The average global illuminance from an overcast sky in Chicago, Ill. on an April day at 1:00 p.m. is 2455 footcandles; on a July day, 1919 footcandles. The average global illuminance in San Diego, Calif. at the same time of day and under overcast conditions is 1796 footcandles; in July, 1590 footcandles. Thus according to the preferred form of the present invention, the range of tasks identified above are able to be performed with at least about 1500 footcandles of ambient light.

In preferred form of the invention, the cap member 24 and base member 12 are both moulded from a plastic resin into a light transmissive plastic suitable for mass produced injection moulding. Adequate results have been obtained with a random copolymer propylene plastic. Ordinary polypropylene is typically a highly crystalline plastic, in which the crystallinity has the effect of reducing light transmission efficiency. Further, typically, polypropylene is dyed to be opaque for outdoor plastic applications. Random copolymer polypropylene has a reduced level of crystallinity which has the effect of increasing light transmission efficiency. On the other hand, the reduced crystallinity of random copolymer polypropylene typically makes it less resistant to impact and cracking than ordinary polypropylene. In the present invention, the use of random copolymer polypropylene resulted in a device having a superior light transmission efficiency, while still having sufficient resistance to impact and cracking to be securable to a roof with nails. Adequate results have been achieved with a resin supplied by ACLO Compounders Inc. of Cambridge, Ontario, Canada. It will be appreciated by those skilled in the art that the present invention comprehends other forms of plastic. What is required is a plastic which can be easily moulded, for example by injection moulding, which is light transmissive, which can be protected from UV degradation and which is still suitable for nailing or the like to a shingle roof.

Adequate illumination results have been obtained with a moulded plastic having a light transmission efficiency of at least forty percent. Most preferably, the mouldable plastic will have a light transmission efficiency of between about fifty and sixty percent. Higher values are also comprehended by the, present invention, but are not generally preferred because to achieve the same requires reduced protection against discoloration by reducing the anti-discoloration additive as set out below.

Also in accordance with the present invention, the plastic resin which is moulded into a translucent plastic includes an additive for inhibiting and preventing early discoloration. The additive is preferably present in sufficiently large quantity to inhibit discoloration of the moulded plastic due to degradation over time and yet in sufficiently small quantity for the plastic to maintain its translucence or light transmission efficiency at acceptable levels.

Typically, a translucent plastic exposed to the outdoor elements would begin to discolour within about five years by turning yellow. This yellowing is largely a result of exposure to ultraviolet light, and occurs regardless of the presence of an ultraviolet inhibitor within the resin, though such an inhibitor does delay the onset of yellowing. The present invention comprehends using an additive to inhibit the plastic from taking on a yellow or discoloured appearance, thus presenting a more aesthetically pleasing look and a longer-lasting product. Preferably, the additive is a coloured pigment. According to an aspect of the present invention sufficient pigment is added to the resin to provide a colored tint to the plastic without reducing light transmission efficiency too much. Reasonable results have been achieved with the addition of a blue pigment in an amount which reduces the light transmission efficiency of the plastic to no more than about 40 percent. The reduction is preferably less than that, namely, to within the range of about 50 to 60 percent.

The invention may be still further illustrated by the following two examples and tests, which are provided by way of example only.

A light transmissibility study was performed on a Translucent Roof Vent Model No. 5950C. The dimensions of the outer flange of this model are 17 inches by 18 inches. The cap member is 12 inches by 12 inches. The study was performed in accordance with the procedures recommended by the Illuminating Engineering Society of North America. To counteract the effects of discoloration through yellowing, a blue pigment was added to the random copolymer polypropylene. Typically, the random copolymer polypropylene-has a light transmission efficiency of about seventy percent, but the addition of pigment reduces that efficiency. In this case, an amount of blue pigment sufficient to prevent discoloration was added to the resin, but, as set out in more detail below, the random copolymer polypropylene maintained sufficient translucence and light transmission efficiency.

A light transmissibility study was performed on this passive venting device. The test was performed with one thousand footcandles of incident sunshine striking the passive venting device directly from above with the passive venting device being disposed horizontally.

The following candle power readings were taken with respect to light passing through the passive venting device:

CANDLEPOWER SUMMARY

| ANGLE | MEAN CP | LUMENS |
|---|---|---|
| 0 | 933 | |
| 5 | 786 | 66 |
| 10 | 511 | |
| 15 | 301 | 84 |
| 20 | 174 | |
| 25 | 109 | 51 |
| 30 | 74 | |
| 35 | 53 | 33 |
| 40 | 39 | |
| 45 | 30 | 23 |
| 50 | 22 | |
| 55 | 11 | 15 |
| 60 | 11 | |
| 65 | 7 | 8 |
| 70 | 4 | |
| 75 | 2 | 3 |
| 80 | 1 | |
| 85 | 1 | 0 |
| 90 | 0 | |

In the above table, the title "Angle" refers to the angle from the vertical, with the downward direction being 0° and the horizontal direction being 90°. The heading "Mean CP" refers to the intensity of light exiting from the passive venting device at various angles. The third heading "Lumens" measures the amount of light passing through a specified angular area as it exits the passive venting device. Therefore, for example, 66 lumens of light were found to be in the annular area whose inner radius is defined by a line extending downward from the passive venting device at an angle 2.5° from vertical, and whose outer radius is similarly defined with respect to the downward extending line angled 7.5° from vertical. Similarly, 84 lumens were detected in the 12.5° to 17.5° range.

As can be seen from these results, the light scatter characteristics of the plastic cause some incoming light to be deflected away from the vertical, despite the incident light being in the vertical direction. Therefore, for example, only 66 lumens of light are in the 2.5°–7.5° range, while 84 lumens of light are in the 12.5°–17.5° range. Significant quantities of light are found all the way out to about 60° from the vertical.

The following table records the amount of light in lumens for each angular zone away from the vertical.

ZONAL LUMENS AND PERCENTAGES

| ZONE | LUMENS | % SUNSHINE | % LUMINAIRE |
|---|---|---|---|
| 0–30 | 201 | 35.75 | 70.97 |
| 0–40 | 234 | 41.69 | 82.75 |
| 0–60 | 272 | 48.48 | 96.24 |
| 0–90 | 283 | 50.38 | 100.00 |
| 40–90 | 48 | 8.69 | 17.25 |
| 60–90 | 10 | 1.90 | 3.76 |
| 90–180 | 0 | .00 | .00 |
| 0–180 | 283 | 50.38 | 100.00 |

In this table the heading "Zone" refers to the angular zone anywhere between 0° and 180°. The second column refers to the number lumens in each angular zone. The next column shows the percentage of the external incident sunshine that is transmitted through the passive venting device into the relevant angular zone. The final column indicates the percentage of the light transmitted through the passive roof venting device which reaches the relevant angular zone.

As can be seen again from these results, the light scatter characteristics of the plastic have the effect (apart from preventing the plastic from being transparent) of illuminating the enclosure not only directly below the passive venting device, but also the enclosed area disposed radially and downwardly away from the passive venting device. This allows the enclosure being vented to be more effectively illuminated by the passive venting device. An aspect of the present invention is the diffuse nature of the light which is transmitted into the enclosure. By reason of the translucency, in combination with the multiple surfaces through which the light travels when passing through the device, the ambient light transmitted into the enclosure (as opposed to the focussed light of this example) tends to spread out into the enclosure providing a desirable, even or soft light in the enclosure.

Note that the second table discloses the overall light transmission efficiency of the passive venting device. Since all transmitted light is in the angular range of 0° to 90°, and the percentage of incident sunshine transmitted in that range is 50.38%, the light transmission efficiency of this passive venting device model is 50.38%. This is a decline in efficiency of approximately 20% as compared with typical random copolymer polypropylene having no added pigment. Adequate illumination results have been obtained at this level of light transmission efficiency such that, under typical daytime ambient light levels, sufficient light is transmitted into the enclosure being vented.

An additional test with the same 1000 footcandles of incident sunshine was done using a model no. 5975C roof vent. The dimensions of the outer flange of this model are 19.5 inches by 20.5 inches. The cap is 14 inches by 14 inches. This model was produced from the same resin as described in the previous example, having the same pigment additive.

The Candlepower Summary and Zonal Lumen tables are reproduced below.

CANDLEPOWER SUMMARY

| ANGLE | MEAN CP | LUMENS |
|---|---|---|
| 0 | 2007 | |
| 5 | 1626 | 132 |
| 10 | 922 | |
| 15 | 462 | 131 |
| 20 | 238 | |
| 25 | 143 | 68 |
| 30 | 98 | |
| 35 | 71 | 45 |
| 40 | 55 | |
| 45 | 44 | 34 |
| 50 | 34 | |
| 55 | 26 | 23 |
| 60 | 18 | |
| 65 | 12 | 12 |
| 70 | 8 | |
| 75 | 4 | 5 |
| 80 | 2 | |
| 85 | 1 | 1 |
| 90 | 0 | |

ZONAL LUMENS AND PERCENTAGES

| ZONE | LUMENS | % SUNSHINE | % LUMINAIRE |
|---|---|---|---|
| 0–30 | 331 | 39.41 | 73.39 |
| 0–40 | 376 | 44.82 | 83.46 |
| 0–60 | 433 | 51.57 | 96.04 |
| 0–90 | 451 | 53.70 | 100.00 |
| 40–90 | 74 | 8.88 | 16.54 |
| 60–90 | 17 | 2.13 | 3.96 |
| 90–180 | 0 | .00 | .00 |
| 0–180 | 451 | 53.70 | 100.00 |

As can be seen from these results, this model, because of its light scatter characteristics, allows for illumination not only directly below the passive venting device, but in areas disposed below and radially away from the passive venting device.

The light transmission efficiency of this model was found to be 53.7%, a drop of approximately 16% as compared to typical resin with no pigment added. Adequate illumination results have been obtained at this efficiency such that, under typical daytime ambient light levels, sufficient light is transmitted into an enclosure being vested.

While the foregoing embodiments of the present invention, including the two examples, have been set forth in considerable detail for the purposes of making a complete disclosure of the invention, it will be apparent to those skilled in the art that various modifications can be made to the device without departing from the broad scope of the invention as defined in the attached claims. Some of these variations are discussed above and others will be apparent to those skilled in the art. For example, the base member and cap member may be integrally moulded together as one piece without being outside the scope of the invention. What is considered important in the present invention is to provide a simple mouldable structure which simultaneously provides the passive venting and passive lighting functions of the present invention. Such a device needs to obscure the rough edges of a hole cut in the roof of a device, and be easy to make and install. The preferred form of material is a random copolymer form of polypropylene, but other materials may also be used provided they provide the required light transmissive properties in combination with acceptable durability and material performance.

I claim:

1. A passive venting device for venting a building enclosure comprising:

a base member having an outer flange for securing said base member in a position to cover an opening in a surface of said building enclosure;

a vent structure for permitting gases and vapors to pass through said device, said vent structure including a filter screen to prevent objects from passing through said device; and a one piece cap member uncloseably mounted to said device in a manner to permit the free flow of air between said one piece cap member and said base member and through said vent structure;

at least said one piece cap member being integrally composed of a translucent material;

wherein external ambient light passes travel through said one piece cap member and through said opening to illuminate the building enclosure.

2. The passive venting device of claim 1 wherein said base member is composed of said translucent material.

3. A passive venting device for a building enclosure comprising:

a base member having an outer flange for securing said base member in position to cover an opening in a surface of said building enclosure;

a vent structure associated with said base member for permitting gases and vapors to pass through said base member; and a one piece cap member uncloseably mounted to said base member and spaced therefrom sufficiently to permit the free flow of air between said one piece cap member and said base member and through said vent structure;

at least one piece cap member being composed of a translucent plastic containing an additive for inhibiting discoloration, said additive being present in an amount sufficient to inhibit discoloration without reducing the light transmissive efficiency of the plastic by more than 50% of the light transmissive efficiency of said translucent plastic in the absence of the additive;

wherein external ambient light may travel through said one piece cap member to illuminate the building enclosure.

4. The passive venting device of claim 1, said translucent material having a sufficient light transmission efficiency such that, under typical daytime ambient light levels, sufficient light is transmitted into said enclosure to allow for simple orientation by a person within said enclosure.

5. The passive venting device of claim 1 said translucent material being a plastic containing an additive for inhibiting discoloration in an amount sufficient to inhibit discoloration without reducing the transmissive efficiency of said device to an amount below 40%.

6. The passive venting device of claim 1, said translucent material having a light transmission efficiency of at least forty percent.

7. The passive venting device of claim 1, said translucent material having a light transmission efficiency of at least fifty percent.

8. The passive venting device of claim 1, said translucent material being a plastic containing an additive for inhibiting discoloration in sufficiently large quantity to inhibit discoloration and in sufficiently small quantity for said plastic to retain its translucence, said plastic having a light transmission of at least fifty percent.

9. The passive venting device of claim 3 wherein said additive is a pigment.

10. The passive venting device of claim 9 wherein said pigment is a blue pigment.

11. A passive venting device for venting a building enclosure comprising:

a base member having an outer flange for securing said base member to a surface;

a vent structure within said base member for permitting gases and vapours to pass through said base member, said vent structure including a filter screen to prevent objects from passing through said base member; and a one piece cap member immovably mounted to said base member and spaced therefrom sufficiently to permit the free flow of air between said one piece cap member and said base member and through said vent structure;

said one piece cap member and base member being integrally composed of a translucent plastic containing a pigment additive for inhibiting discoloration in sufficiently large quantity to inhibit discoloration and in sufficiently small quantity to maintain the translucence of said plastic, said plastic having a light transmission efficiency of at least fifty percent;

wherein external ambient light may travel through said one piece cap member to illuminate the building enclosure.

12. The passive venting device of claim 11, said pigment being blue.

13. The passive venting device of claim 1, said translucent material being a random copolymer polypropylene.

14. The passive venting device of claim 1, said translucent material being a random copolymer polypropylene, wherein said random copolymer polypropylene includes an additive for inhibiting discoloration in sufficiently large quantity to inhibit discoloration and in sufficiently small quantity to maintain the translucence of said random copolymer polypropylene.

15. The passive venting device of claim 14 wherein the random copolymer polypropylene with said additive has a light transmission efficiency of at least forty percent.

16. The passive venting device of claim 14 wherein said random copolymer polypropylene with said additive has a light transmission efficiency of at least fifty percent.

17. The passive venting device of claim 14, said additive being a pigment.

18. The passive venting device of claim 14, said additive being a blue pigment.

19. The passive venting device of claim 3, said translucent plastic resin having a sufficient light transmission efficiency such that under typical daytime ambient light levels, sufficient light is transmitted into said enclosure to allow for simple orientation by a person within said enclosure.

20. A passive venting device for venting a building enclosure comprising:

a base member having an outer flange for securing said base member to a surface;

a vent structure within said base member for permitting gases and vapours to pass through said base member, said vent structure including a filter screen to prevent objects from passing through said base member; and a one piece cap member immovably mounted to said base member and spaced therefrom sufficiently to permit the free flow of air between said one piece cap member and said base member and through said vent structure;

said one piece cap member and base member being integrally composed of a translucent random copolymer polypropylene plastic containing a blue pigment additive for inhibiting discoloration in sufficiently large quantity to inhibit discoloration and in sufficiently small quantity to maintain the translucence of said plastic, said plastic having a light transmission efficiency of at least fifty percent wherein external ambient light may travel through said cap member to illuminate the building enclosure.

21. The passive venting device of claim 3, said translucent material being a random copolymer polypropylene.

* * * * *

UNITED STATES PATENT AND TRADEMARK OFFICE

CERTIFICATE OF CORRECTION

PATENT NO. : 6,155,008
DATED : December 5, 2000
INVENTOR(S) : McKee

It is certified that error appears in the above-identified patent and that said Letters Patent is hereby corrected as shown below:

Title page,
Under Attorney, Agent or Firm, the printed patent incorrectly reads "Hoffman & Baron, LLP"; the patent should read -- Hoffmann & Baron, LLP --.

Column 6,
Line 58, the printed patent in the table incorrectly reads "11 MEAN CP for an ANGLE of 55"; the patent should read -- 17 MEAN CP for an ANGLE of 55 --.

Column 8,
Line 59, the printed patent incorrectly reads "being vested"; the patent should read -- being vented --.

Signed and Sealed this

Fourth Day of September, 2001

*Attest:*

Nicholas P. Godici

*Attesting Officer*

NICHOLAS P. GODICI
*Acting Director of the United States Patent and Trademark Office*